US008904671B2

(12) United States Patent
Dojan et al.

(10) Patent No.: US 8,904,671 B2
(45) **Date of Patent: *Dec. 9, 2014**

(54) FOOTWEAR INCORPORATING A TENSILE ELEMENT WITH A DEPOSITION LAYER

(75) Inventors: Frederick J. Dojan, Vancouver, WA (US); Chin-Chen Huang, Taichung (TW); Daniel A. Johnson, Taichung (TW)

(73) Assignee: NIKE, Inc., Beaverton, OR (US)

( * ) Notice: Subject to any disclaimer, the term of this patent is extended or adjusted under 35 U.S.C. 154(b) by 606 days.

This patent is subject to a terminal disclaimer.

(21) Appl. No.: 13/196,365

(22) Filed: Aug. 2, 2011

(65) Prior Publication Data

US 2012/0055044 A1 Mar. 8, 2012

Related U.S. Application Data

(63) Continuation-in-part of application No. 12/505,740, filed on Jul. 20, 2009, now Pat. No. 8,312,645, which is a continuation-in-part of application No. 11/441,924, filed on May 25, 2006, now Pat. No. 7,870,681.

(51) Int. Cl.

| | |
|---|---|
| ***A43B 23/00*** | (2006.01) |
| ***A43B 23/02*** | (2006.01) |
| ***A43B 3/26*** | (2006.01) |
| ***A43B 1/00*** | (2006.01) |
| ***A43B 3/00*** | (2006.01) |
| ***A43B 5/06*** | (2006.01) |

(52) U.S. Cl.

CPC ..... *A43B 3/26* (2013.01); *A43B 1/0027* (2013.01); *A43B 3/0084* (2013.01); *A43B 5/06* (2013.01); *A43B 23/02* (2013.01); *A43B 23/0225* (2013.01); *A43B 23/0235* (2013.01); *A43B 23/0255* (2013.01); *A43B 23/0265* (2013.01)

USPC ..... 36/45; 36/47; 36/51

(58) Field of Classification Search

CPC .. A43B 7/1495; A43B 11/00; A43B 23/0265; A43C 11/14; A43C 1/00; A43C 11/008

USPC ..... 36/50.1, 45, 114, 47, 88, 93, 51

See application file for complete search history.

(56) References Cited

U.S. PATENT DOCUMENTS

| | | | |
|---|---|---|---|
| 2,034,091 | A | 3/1936 | Dunbar |
| 2,048,294 | A | 7/1936 | Roberts |

(Continued)

FOREIGN PATENT DOCUMENTS

| | | | |
|---|---|---|---|
| CN | 101125044 | A | 2/2008 |
| DE | 20215559 | | 1/2003 |

(Continued)

OTHER PUBLICATIONS

Notice of Allowance for U.S. Appl. No. 12/505,740 mailed on Sep. 19, 2012.

(Continued)

*Primary Examiner* — Jila M Mohandesi

(74) *Attorney, Agent, or Firm* — Plumsea Law Group, LLC

(57) ABSTRACT

An article of footwear may have an upper and a sole structure secured to the upper. The upper includes a base layer, a plurality of strand segments, and a deposition layer. The a base layer has a first surface and an opposite second surface. The strand segments are located adjacent to the first surface and extend substantially parallel to the first surface for a distance of at least five centimeters. The deposition layer is deposited upon the first surface and the strand segments, and the deposition layer is joined with the first surface and the strand segments.

16 Claims, 19 Drawing Sheets

(56) References Cited

U.S. PATENT DOCUMENTS

| | | | |
|---|---|---|---|
| 2,205,356 | A | 6/1940 | Gruensfelder |
| 2,311,996 | A | 2/1943 | Parker |
| 3,439,434 | A | 4/1969 | Tangorra |
| 3,672,078 | A | 6/1972 | Fukuoka |
| 3,823,493 | A | 7/1974 | Brehm et al. |
| 4,627,369 | A | 12/1986 | Conrad et al. |
| 4,634,616 | A | 1/1987 | Musante |
| 4,642,819 | A | 2/1987 | Ales et al. |
| 4,756,098 | A | 7/1988 | Boggia |
| 4,858,339 | A | 8/1989 | Hayafuchi et al. |
| 4,873,725 | A | 10/1989 | Mitchell |
| 5,149,388 | A | 9/1992 | Stahl |
| 5,156,022 | A | 10/1992 | Altman |
| 5,271,130 | A | 12/1993 | Batra |
| 5,285,658 | A | 2/1994 | Altman et al. |
| 5,345,638 | A | 9/1994 | Nishida |
| 5,359,790 | A | 11/1994 | Iverson et al. |
| 5,367,795 | A | 11/1994 | Iverson et al. |
| 5,380,480 | A | 1/1995 | Okine et al. |
| 5,399,410 | A | 3/1995 | Urase |
| 5,645,935 | A | 7/1997 | Kemper et al. |
| 5,832,540 | A | 11/1998 | Knight |
| D405,587 | S | 2/1999 | Merikoski |
| 5,930,918 | A | 8/1999 | Healy |
| 5,990,378 | A | 11/1999 | Ellis |
| 6,003,247 | A | 12/1999 | Steffe |
| 6,004,891 | A | 12/1999 | Tuppin et al. |
| 6,009,637 | A | 1/2000 | Pavone |
| 6,029,376 | A | 2/2000 | Cass |
| 6,038,702 | A | 3/2000 | Knerr |
| 6,128,835 | A | 10/2000 | Ritter |
| 6,151,804 | A | 11/2000 | Hieblinger |
| 6,164,228 | A | 12/2000 | Lin |
| 6,170,175 | B1 | 1/2001 | Funk |
| 6,213,634 | B1 | 4/2001 | Harrington et al. |
| 6,615,427 | B1 | 9/2003 | Hailey |
| 6,665,958 | B2 | 12/2003 | Goodwin |
| 6,718,895 | B1 | 4/2004 | Fortuna |
| 6,860,214 | B1 | 3/2005 | Wang |
| 6,910,288 | B2 | 6/2005 | Dua |
| 7,086,179 | B2 | 8/2006 | Dojan |
| 7,086,180 | B2 | 8/2006 | Dojan |
| 7,100,310 | B2 | 9/2006 | Foxen |
| 7,293,371 | B2 | 11/2007 | Aveni |
| 7,337,560 | B2 | 3/2008 | Marvin et al. |
| 7,574,818 | B2 | 8/2009 | Meschter |
| 7,665,230 | B2 | 2/2010 | Dojan |
| 7,676,956 | B2 | 3/2010 | Dojan |
| 7,849,518 | B2 | 12/2010 | Moore et al. |
| 7,870,681 | B2 | 1/2011 | Meschter |
| 7,870,682 | B2 | 1/2011 | Meschter et al. |
| 2001/0051484 | A1 | 12/2001 | Ishida et al. |
| 2003/0178738 | A1 | 9/2003 | Staub et al. |
| 2004/0074589 | A1 | 4/2004 | Gessler et al. |
| 2004/0118018 | A1 | 6/2004 | Dua |
| 2004/0142631 | A1 | 7/2004 | Luk |
| 2004/0181972 | A1 | 9/2004 | Csorba |
| 2004/0261295 | A1 | 12/2004 | Meschter |
| 2005/0028403 | A1 | 2/2005 | Swigart |
| 2005/0115284 | A1 | 6/2005 | Dua |
| 2005/0132609 | A1 | 6/2005 | Dojan |
| 2005/0268497 | A1 | 12/2005 | Alfaro |
| 2006/0048413 | A1 | 3/2006 | Sokolowski et al. |
| 2006/0137221 | A1 | 6/2006 | Dojan |
| 2007/0199210 | A1 | 8/2007 | Vattes et al. |
| 2007/0271821 | A1 | 11/2007 | Meschter |
| 2008/0110049 | A1 | 5/2008 | Sokolowski et al. |
| 2010/0018075 | A1 | 1/2010 | Meschter et al. |
| 2010/0037483 | A1 | 2/2010 | Meschter et al. |
| 2010/0043253 | A1 | 2/2010 | Dojan et al. |
| 2010/0154256 | A1 | 6/2010 | Dua |
| 2010/0175276 | A1 | 7/2010 | Dojan et al. |
| 2010/0251491 | A1 | 10/2010 | Dojan et al. |
| 2010/0251564 | A1 | 10/2010 | Meschter |
| 2011/0041359 | A1 | 2/2011 | Dojan et al. |

FOREIGN PATENT DOCUMENTS

| | | |
|---|---|---|
| EP | 0082824 | 6/1983 |
| EP | 0818289 | 1/1998 |
| FR | 1462349 | 2/1967 |
| FR | 2046671 | 3/1971 |
| FR | 2457651 | 12/1980 |
| WO | 9843506 | 10/1998 |
| WO | 03013301 | 2/2003 |
| WO | WO2004089609 | 10/2004 |
| WO | WO2007139567 | 12/2007 |
| WO | WO2007140055 | 12/2007 |

OTHER PUBLICATIONS

Notice of Allowance for U.S. Appl. No. 12/546,017 mailed on Sep. 19, 2012.

International Search Report and Written Opinion in PCT Application No. PCT/US2012/048008, mailed on Dec. 7, 2012.

International Preliminary Report on Patentability (including Written Opinion of the ISA) mailed Feb. 13, 2014 in International Application No. PCT/US2012/048008.

FOOTWEAR INCORPORATING A TENSILE ELEMENT WITH A DEPOSITION LAYER

CROSS-REFERENCE TO RELATED APPLICATIONS

This U.S. Patent Application is a continuation-in-part application and claims priority under 35 U.S.C. §120 to U.S. patent application Ser. No. 12/505,740, which was filed in the U.S. Patent and Trademark Office on 20 Jul. 2009 and entitled Material Elements Incorporating Tensile Strands, which issued on Nov. 20, 2012 as U.S. Pat. No. 8,312,645, such prior U.S. Patent Application being entirely incorporated herein by reference. In turn, U.S. patent application Ser. No. 12/505,740 is a continuation-in-part application and claims priority under 35 U.S.C. §120 to U.S. patent application Ser. No. 11/441,924, which was filed in the U.S. Patent and Trademark Office on 25 May 2006 and entitled Article Of Footwear Having An Upper With Thread Structural Elements, which issued on Jan. 18, 2011 as U.S. Pat. No. 7,870,681, such prior U.S. Patent Application being entirely incorporated herein by reference.

BACKGROUND

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust fit of the footwear, as well as permitting entry and removal of the foot from the void within the upper. In addition, the upper may include a tongue that extends under the lacing system to enhance adjustability and comfort of the footwear, and the upper may incorporate a heel counter.

The various material elements forming the upper impart different properties to different areas of the upper. For example, textile elements may provide breathability and may absorb moisture from the foot, foam layers may compress to impart comfort, and leather may impart durability and wear-resistance. As the number of material elements increases, the overall mass of the footwear may increase proportionally. The time and expense associated with transporting, stocking, cutting, and joining the material elements may also increase. Additionally, waste material from cutting and stitching processes may accumulate to a greater degree as the number of material elements incorporated into an upper increases. Moreover, products with a greater number of material elements may be more difficult to recycle than products formed from fewer material elements. By decreasing the number of material elements, therefore, the mass of the footwear and waste may be decreased, while increasing manufacturing efficiency and recyclability.

The sole structure is secured to a lower portion of the upper so as to be positioned between the foot and the ground. In athletic footwear, for example, the sole structure includes a midsole and an outsole. The midsole may be formed from a polymer foam material that attenuates ground reaction forces (i.e., provides cushioning) during walking, running, and other ambulatory activities. The midsole may also include fluid-filled chambers, plates, moderators, or other elements that further attenuate forces, enhance stability, or influence the motions of the foot, for example. The outsole forms a ground-contacting element of the footwear and is usually fashioned from a durable and wear-resistant rubber material that includes texturing to impart traction. The sole structure may also include a sockliner positioned within the upper and proximal a lower surface of the foot to enhance footwear comfort.

SUMMARY

An article of footwear is described below as having an upper and a sole structure secured to the upper. The upper includes a base layer, a plurality of strand segments, and a deposition layer. The a base layer has a first surface and an opposite second surface. The strand segments are located adjacent to the first surface and extend substantially parallel to the first surface for a distance of at least five centimeters. The deposition layer is deposited upon the first surface and the strand segments, and the deposition layer is joined with the first surface and the strand segments.

A screen print layer is also described below. The screen print layer is deposited upon the first surface of the base layer and the strand segments. Additionally, the screen print layer is joined with the first surface and the strand segments.

In addition, a method of manufacturing an article of footwear is described below.

The method includes laying a plurality of strand segments adjacent to a base layer, with at least a portion of the strand segments extending substantially parallel to the base layer for a distance of at least five centimeters. An at least partially liquid material is deposited onto the base layer and the strand segments to form a deposition layer, the strand segments being located between the base layer and the deposition layer. The base layer, strand segments, and deposition layer are incorporated into an upper of the article of footwear.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose an article of footwear having an upper that includes tensile strand elements. The article of footwear is disclosed as having a general configuration suitable for walking or running. Concepts associated with the footwear, including the upper, may also be applied to a variety of other athletic footwear types, including baseball shoes, basketball shoes, cross-training shoes, cycling shoes, football shoes, tennis shoes, soccer shoes, and hiking boots, for example. The concepts may also be applied to footwear types that are generally considered to be non-athletic, including dress shoes, loafers, sandals, and work boots. The concepts disclosed herein apply, therefore, to a wide variety of footwear types.

General Footwear Structure

Figure 1:
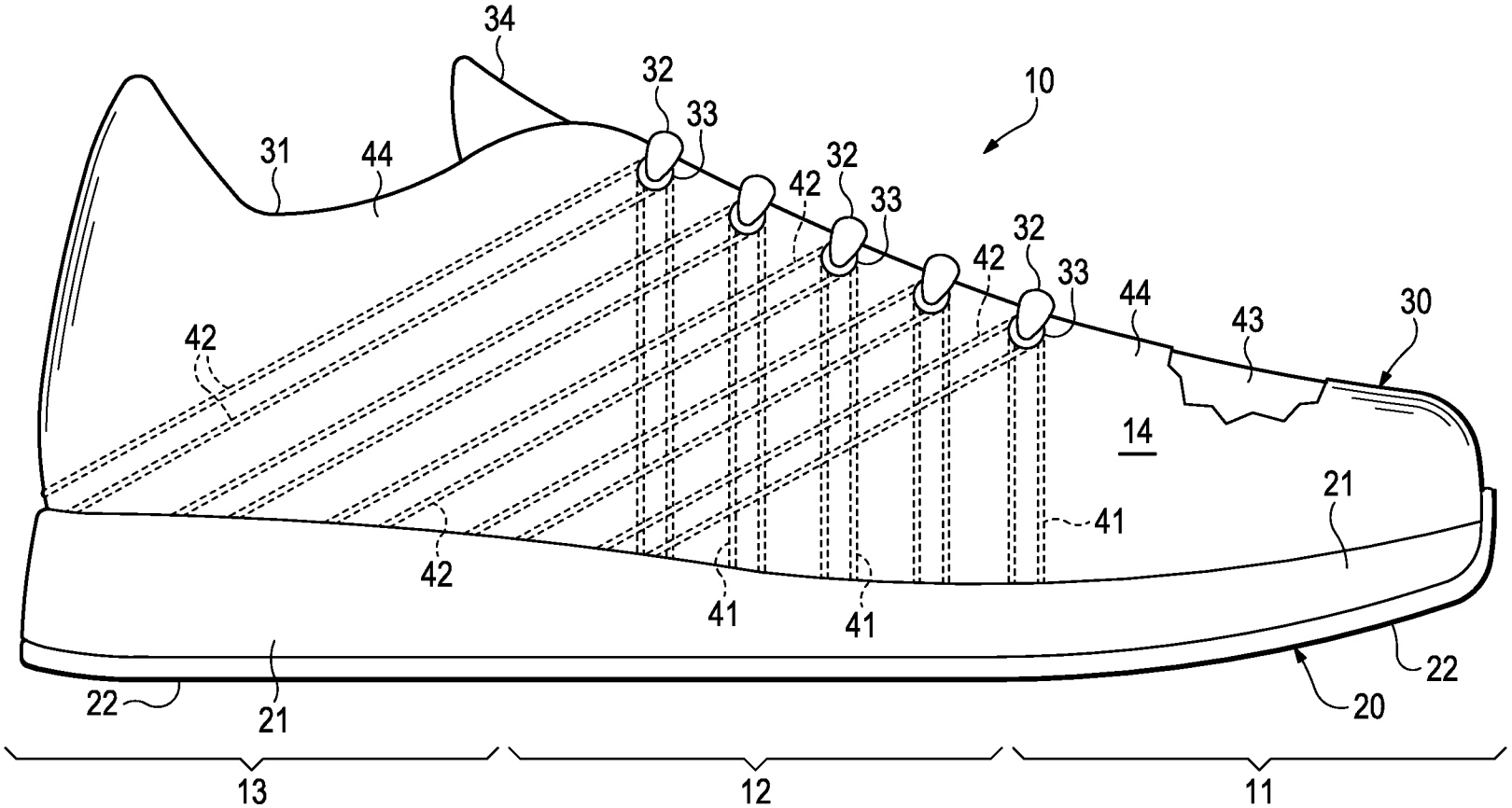
FIG. 1 is a lateral side elevational view of an article of footwear.
Figure 2:
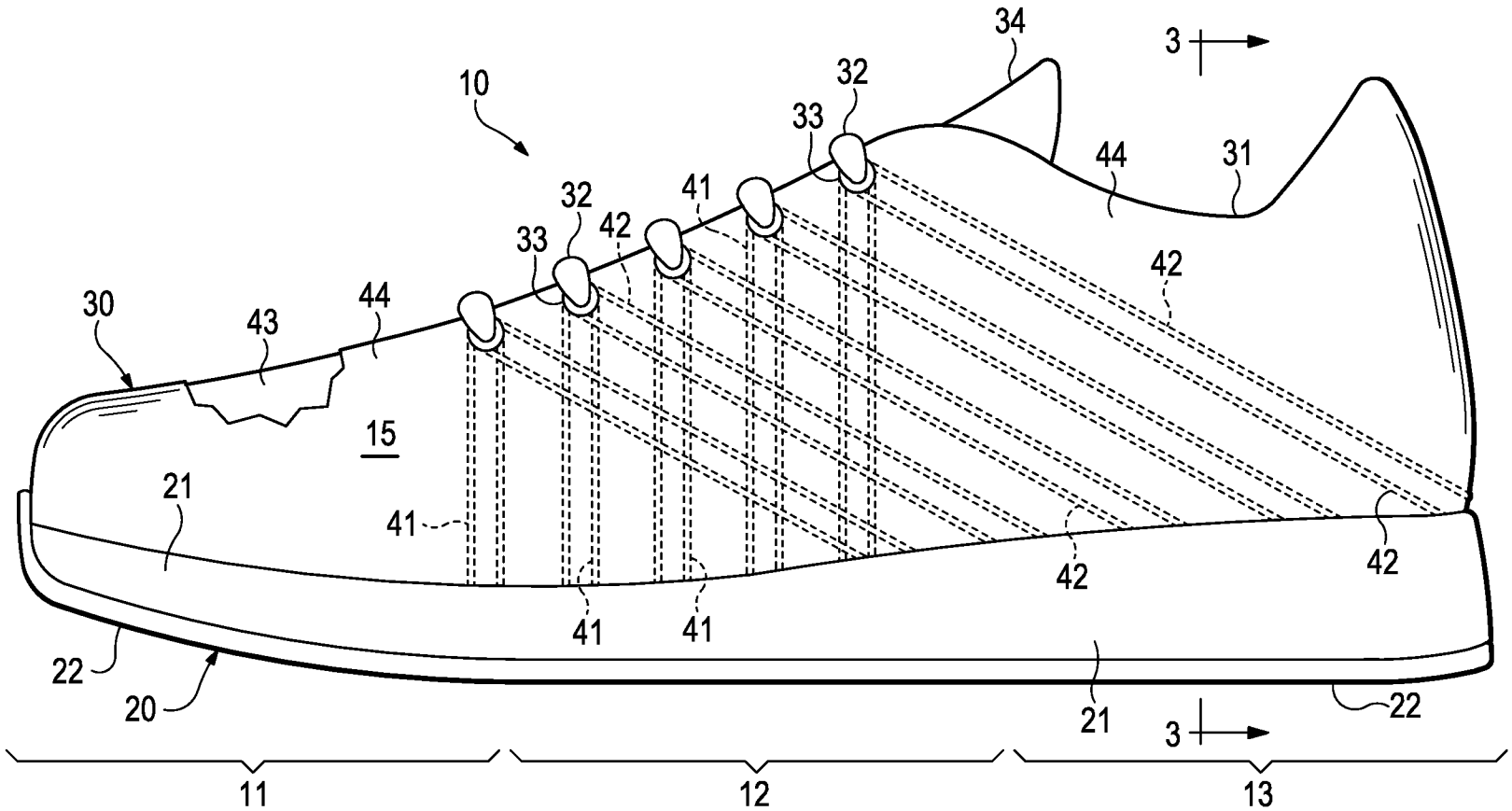
FIG. 2 is a medial side elevational view of the article of footwear.
Figure 3:
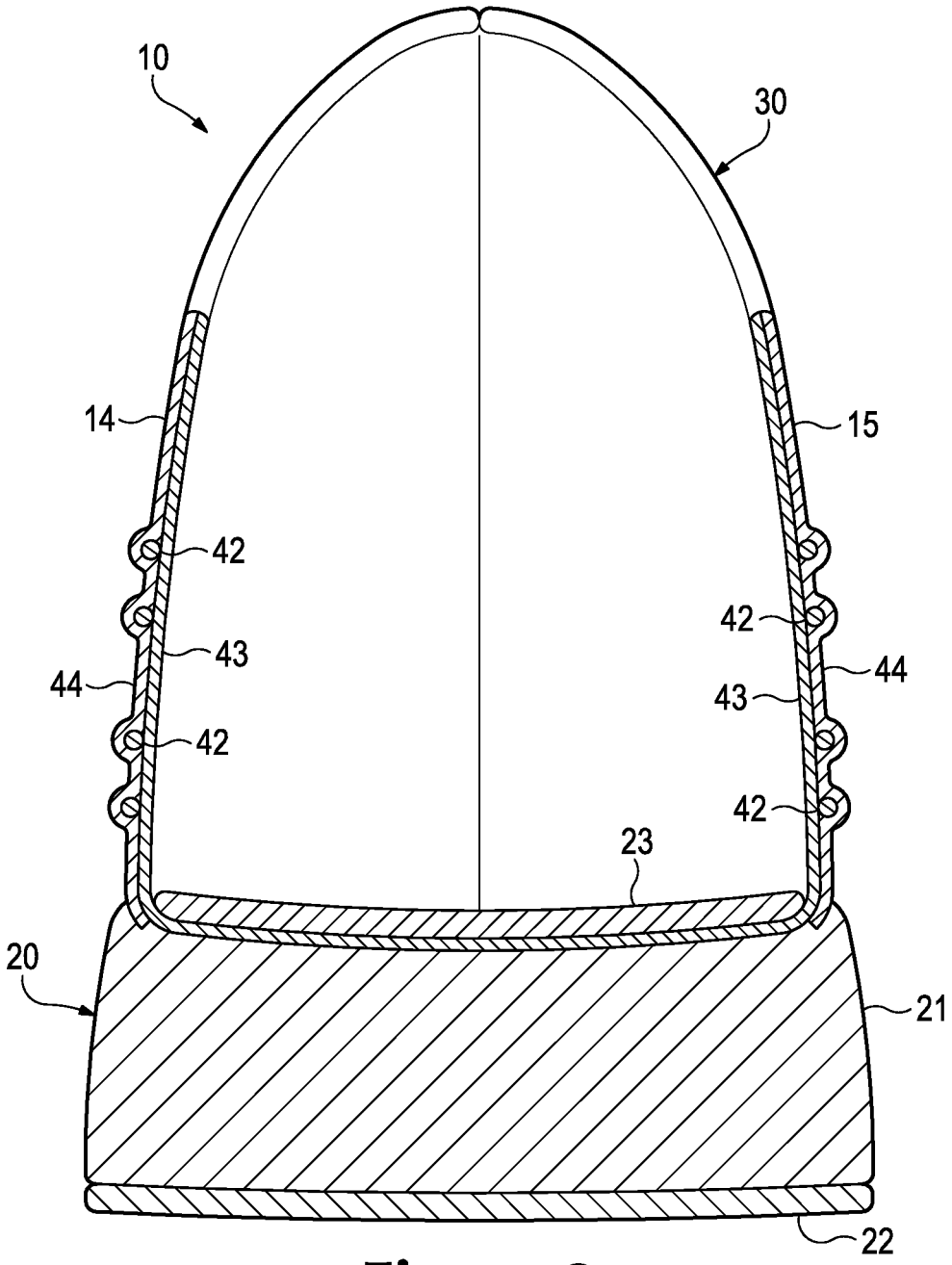
FIG. 3 is a cross-sectional view of the article of footwear, as defined by section line 3-3 in FIG. 2.

An article of footwear 10 is depicted in FIGS. 1-3 as including a sole structure 20 and an upper 30. For reference purposes, footwear 10 may be divided into three general regions: a forefoot region 11, a midfoot region 12, and a heel region 13, as shown in FIGS. 1 and 2. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Lateral side 14 and medial side 15 extend through each of regions 11-13 and correspond with opposite sides of footwear 10. More particularly, lateral side 14 corresponds with an outside area of the foot (i.e. the surface that faces away from the other foot), and medial side 15 corresponds with an inside area of the foot (i.e., the surface that faces toward the other foot). Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to sole structure 20, upper 30, and individual elements thereof.

Sole structure 20 is secured to upper 30 and extends between the foot and the ground when footwear 10 is worn. The primary elements of sole structure 20 are a midsole 21, an outsole 22, and an sockliner 23. Midsole 21 is secured to a lower surface of upper 30 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, midsole 21 may incorporate fluid-filled chambers, plates, moderators, or other elements that further attenuate forces, enhance stability, or influence the motions of the foot, or midsole 21 may be primarily formed from a fluid-filled chamber. Outsole 22 is secured to a lower surface of midsole 21 and may be formed from a wear-resistant rubber material that is textured to impart traction. Sockliner 23 is located within upper 30 and is positioned to extend under a lower surface of the foot. Although this configuration for sole structure 20 provides an example of a sole structure that may be used in connection with upper 30, a variety of other conventional or nonconventional configurations for sole structure 20 may also be utilized. Accordingly, the structure and features of sole structure 20 or any sole structure utilized with upper 30 may vary considerably.

The various portions of upper 30 may be formed from one or more of a plurality of material elements (e.g., textiles, polymer sheets, foam layers, leather, synthetic leather) that are stitched or bonded together to form a void within footwear 10 for receiving and securing a foot relative to sole structure 20. The void is shaped to accommodate the foot and extends along the lateral side of the foot, along the medial side of the foot, over the foot, around the heel, and under the foot. Access to the void is provided by an ankle opening 31 located in at least heel region 13. A lace 32 extends through various lace apertures 33 and permits the wearer to modify dimensions of upper 30 to accommodate the proportions of the foot. More particularly, lace 32 permits the wearer to tighten upper 30 around the foot, and lace 32 permits the wearer to loosen upper 30 to facilitate entry and removal of the foot from the void (i.e., through ankle opening 31). As an alternative to lace apertures 33, upper 30 may include other lace-receiving elements, such as loops, eyelets, and D-rings. In addition, upper 30 includes a tongue 34 that extends between the interior void and lace 32 to enhance the comfort of footwear 10. In some configurations, upper 30 may incorporate a heel counter that limits heel movement in heel region 13 or a wear-resistant toe guard located in forefoot region 11.

A variety of material elements or other components may be incorporated into upper 30, as discussed above. In addition, areas of one or both of lateral side 14 and medial side 15 incorporate various first strands 41 and second strands 42. When incorporated into upper 30, strands 41 and 42 are located between a base layer 43 and a deposition layer 44, as depicted in FIG. 3. Whereas base layer 43 forms a surface of the void within upper 30, deposition layer 44 forms a portion of an exterior or exposed surface of upper 30. The combination of first strands 41, second strands 42, base layer 43, and deposition layer 44 may, therefore, form substantially all of a thickness of upper 30 in some areas.

Strand Configuration

The locations and orientations of strands 41 and 42 may vary significantly. As an example, FIGS. 1 and 2 depict strands 41 and 42 as extending downward from lace apertures 33 and toward sole structure 20. More particularly, various segments of strands 41 and 42 (i.e., strand segments) extend from a throat region of upper 30 (i.e., the region where lace 32, lace apertures 33, and tongue 34 are located) to a lower region of upper 30 (i.e., the region where sole structure 20 joins with upper 30). Whereas first strands 41 are oriented in a generally vertical direction in an area between lace apertures 33 and sole structure 20, second strands 42 are oriented in a rearwardly-angled direction in the area between lace apertures 33 and sole structure 20. A similar configuration is disclosed in U.S. patent application Ser. No. 12/847,836, which was filed in the U.S. Patent and Trademark Office on 30 Jul. 2010 and entitled Footwear Incorporating Angled Tensile Strand Elements, such application being incorporated herein by reference. The orientations for strands 41 and 42 assist, for example, with cutting motions (i.e., side-to-side movements of the wearer) and braking motions (i.e., slowing the forward momentum of the wearer). More particularly, segments of first strands 41 resist stretch in upper 30 due to cutting motions and ensure that the foot remains properly positioned relative to footwear 10, and segments of second strands 42 resist stretch in upper 30 due to braking motions, as well as jumping and running motions that flex or otherwise bend footwear 10. As discussed in greater detail below, segments of strands 41 and 42 may be oriented in other ways and located in other areas of upper 30. Accordingly, the configuration of the strands 41 and 42, as well as the segments of strands 41 and 42, in FIGS. 1 and 2 is intended to provide an example of a suitable configuration for footwear 10.

During activities that involve walking, running, or other ambulatory movements (e.g., cutting, braking), a foot within the void in footwear 10 may tend to stretch upper 30. That is, many of the material elements forming upper 30 may stretch when placed in tension by movements of the foot. Although strands 41 and 42 may also stretch, strands 41 and 42 generally stretch to a lesser degree than the other material elements forming upper 30 (e.g., base layer 43 and deposition layer 44). Each of the segments of strands 41 and 42 may be located, therefore, to form structural components in upper 30 that (a) resist stretching in specific directions or locations, (b) limit excess movement of the foot relative to sole structure 20 and upper 30, (c) ensure that the foot remains properly positioned relative to sole structure 20 and upper 30, and (d) reinforce locations where forces are concentrated.

Suitable materials for strands 41 and 42 include various filaments, fibers, yarns, threads, cables, or ropes that are formed from rayon, nylon, polyester, polyacrylic, silk, cotton, carbon, glass, aramids (e.g., para-aramid fibers and meta-aramid fibers), ultra high molecular weight polyethylene, liquid crystal polymer, copper, aluminum, or steel, for example. Although strands 41 and 42 may be formed from similar materials, second strands 42 may be formed to have a greater tensile strength than first strands 41. As an example, strands 41 and 42 may be formed from the same material, but the thickness of second strands 42 may be greater than the thickness of first strands 41 to impart greater tensile strength. As another example, strands 41 and 42 may be formed from different materials, with the tensile strength of the material forming second strands 42 being greater than the tensile strength of the material forming first strands 41. The rationale for this difference between strands 41 and 42 is that the forces induced in upper 30 during braking motions are often greater than the forces induced in upper 30 during cutting motions. In order to account for the differences in the forces from braking and cutting, strands 41 and 42 may exhibit different tensile strengths. As a specific example of suitable materials, first strands 41 may be formed from a bonded nylon 6.6 with a breaking or tensile strength of 3.1 kilograms and a weight of 45 tex (i.e., a weight of 45 grams per kilometer of material) and second strands 42 may be formed from a bonded nylon 6.6 with a breaking or tensile strength of 6.2 kilograms and a tex of 45.

Tensile Element Configuration

Figure 4:
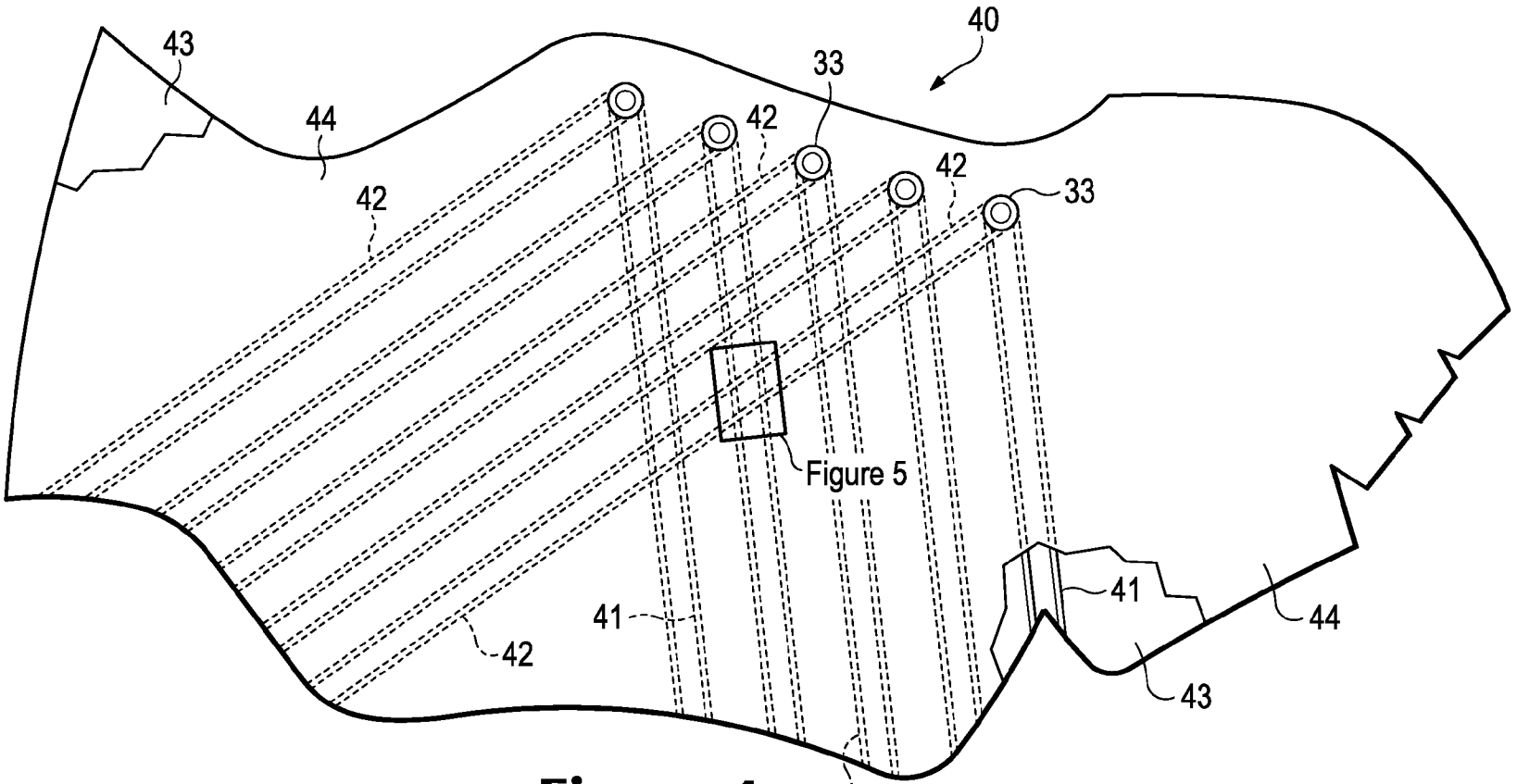
FIG. 4 is a plan view of a tensile element utilized in an upper of the article of footwear.
Figure 5:
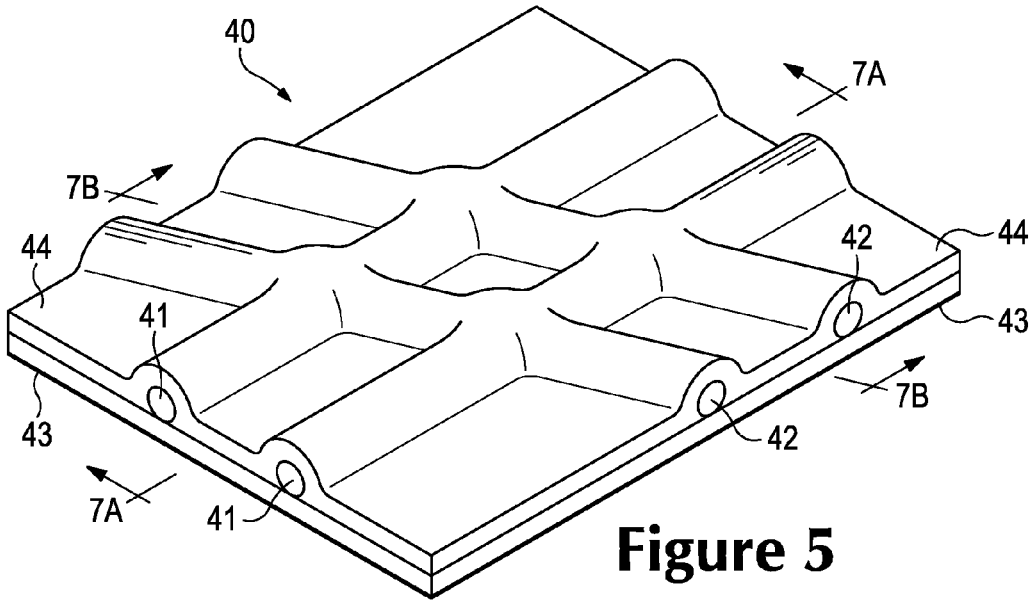
FIG. 5 is a perspective view of a portion of the tensile element, as defined in FIG. 4.
Figure 6:
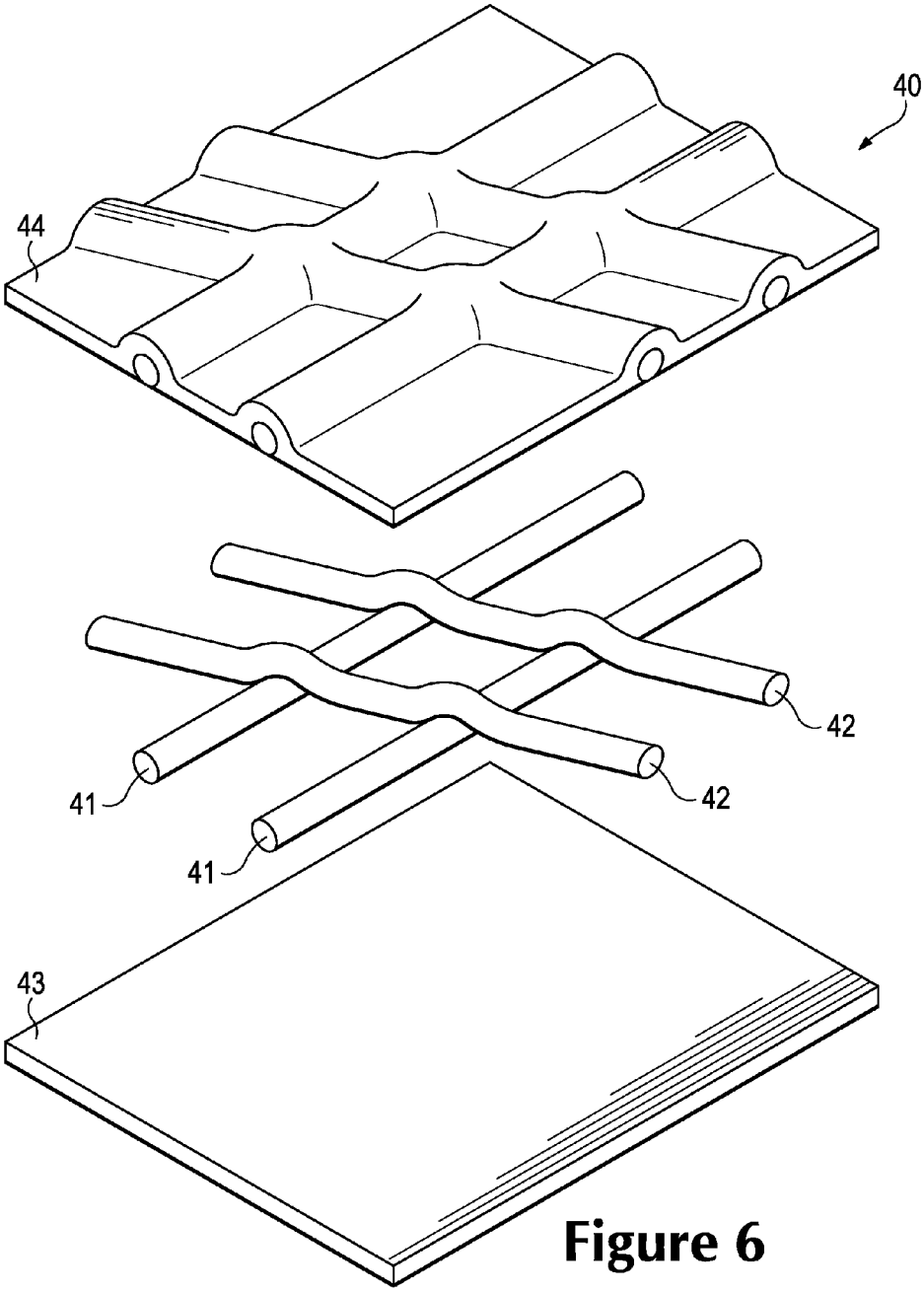
FIG. 6 is an exploded perspective view of the portion of the tensile element.
Figure 7A:
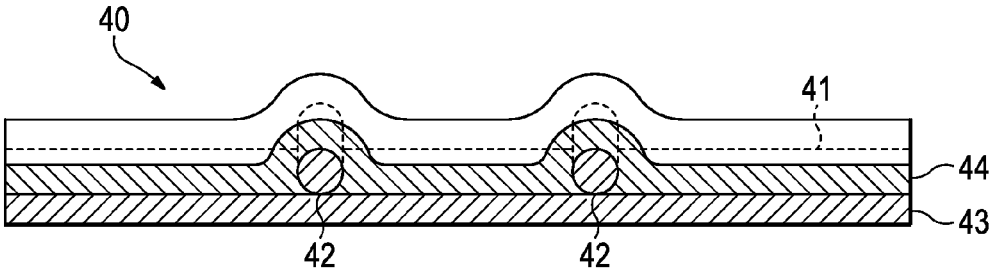
FIGS. 7A and 7B are a cross-sectional views of the portion of the tensile strand element, as defined by section lines 7A and 7B in FIG. 5.
Figure 7B:
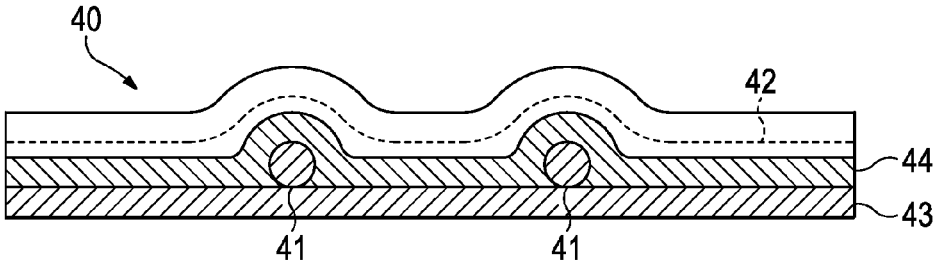

A tensile element 40 that may be incorporated into upper 30 is depicted in FIG. 4. Additionally, a portion of tensile element 40 is depicted in each of FIGS. 5-7B. Tensile element 40 may form, for example, a majority of lateral side 14. As a result, tensile element 40 has a configuration that (a) extends from the lace region to the lower region of lateral side 14 and through each of regions 11-13, (b) defines the various lace apertures 33 in lateral side 14, and (c) forms both an interior surface (i.e., the surface that contacts the foot or a sock worn by the foot when footwear 10 is worn) and an exterior surface (i.e., an outer, exposed surface of footwear 10). A substantially similar element may also be utilized for medial side 15. In some configurations of footwear 10, tensile element 40 may only extend through a portion of lateral side 14 (e.g., limited to midfoot region 12) or may be expanded to form both lateral side 14 and medial side 15. That is, a single element having the general configuration of tensile element 40 and including strands 41 and 42 and layers 43 and 44 may extend through both lateral side 14 and medial side 15. In other configurations, additional elements may be joined to tensile element 40 to form portions of lateral side 14.

Base layer 43 and deposition layer 44 lay adjacent to each other, with strands 41 and 42 being positioned between layers 43 and 44. Strands 41 and 42 lie adjacent to a surface of base layer 43 and substantially parallel to the surface of base layer 43. In general, strands 41 and 42 also lie adjacent to a surface of deposition layer 44 and substantially parallel to the surface of deposition layer 44. As discussed above, segments of strands 41 and 42 form structural components in upper 30 that resist stretch. By being substantially parallel to the surfaces of base layer 43 and deposition layer 44, the segments of strands 41 and 42 resist stretch in directions that correspond with the surfaces of layers 43 and 44. Although strands 41 and 42 may extend through base layer 43 (e.g., as a result of stitching) in some locations, areas where strands 41 and 42 extend through base layer 43 may permit stretch, thereby reducing the overall ability of strands 41 and 42 to limit stretch. As a result, the segments of each of strands 41 and 42 generally lie adjacent to a surface of base layer 43 and substantially parallel to the surface of base layer 43 for distances of at least twelve millimeters, and may lie adjacent to the surface of base layer 43 and substantially parallel to the surface of base layer 43 throughout distances of five centimeters or more.

Layers 43 and 44 are depicted as being coextensive with each other. That is, layers 43 and 44 may have the same shape and size, such that edges of base layer 43 correspond and are even with edges of deposition layer 44. In some manufacturing processes, (a) strands 41 and 42 are located upon base layer 43, (b) deposition layer 44 is applied to base layer 43 and strands 41 and 42, and (c) tensile element 40 is cut from this combination to have the desired shape and size, thereby forming common edges for base layer 43 and deposition layer 44. In this process, ends of strands 41 and 42 may also extend to edges of layers 43 and 44. Accordingly, edges of layers 43 and 44, as well as ends of strands 41 and 42, may all be positioned at edges of tensile element 40.

Base layer 43 may be formed from any generally flat material exhibiting a length and a width that are substantially greater than a thickness. Accordingly, suitable materials for base layer 43 include various textiles, polymer sheets, or combinations of textiles and polymer sheets, for example. Textiles are generally manufactured from fibers, filaments, or yarns that are, for example, either (a) produced directly from webs of fibers by bonding, fusing, or interlocking to construct non-woven fabrics and felts or (b) formed through a mechanical manipulation of yarn to produce a woven or knitted fabric. The textiles may incorporate fibers that are arranged to impart one-directional stretch or multi-directional stretch, and the textiles may include coatings that form a breathable and water-resistant barrier, for example. The polymer sheets may be extruded, rolled, or otherwise formed from a polymer material to exhibit a generally flat aspect. Suitable materials for base layer 43 may also encompass laminated or otherwise layered materials that include two or more layers of textiles, polymer sheets, or combinations of textiles and polymer sheets. In addition to textiles and polymer sheets, other materials may be utilized for base layer 43. Although the materials may have smooth or generally untextured surfaces, some materials forming base layer 43 will exhibit textures or other surface characteristics, such as dimpling, protrusions, ribs, or various patterns, for example. In some configurations, mesh materials or perforated materials may be utilized for base layer 43 to impart greater breathability or air permeability.

Deposition layer 44 may be formed from any material that is deposited upon base layer 43 and strands 41 and 42. As utilized herein, the term "deposit" or variants thereof (e.g., deposited, depositing) is intended to encompass the formation of a layer through spraying, printing, electroplating, filament accumulation, or similar processes. In each of these processes, relatively small drops of a material or a liquid form of the material is applied to base layer 43 and strands 41 and 42 to form deposition layer 44. In effect, therefore, deposition layer 44 is formed or built-up directly upon base layer 43 and strands 41 and 42. In some prior configurations, a pre-formed polymer sheet was utilized to cover a base layer and strands. That is, the polymer sheet for formed prior to being joined with the base layer and strands. In contrast, deposition layer 44 is formed by depositing relatively small drops of a material or a liquid form of the material through spraying, printing, electroplating, filament accumulation, or similar processes.

As noted above, spraying, printing, electroplating, filament accumulation, or similar processes may be utilized to deposit deposition layer 44 upon base layer 43 and strands 41 and 42. When deposited through spraying, a polymer resin, a melted polymer, an adhesive, or an at least partially liquid material, for example, may be aerosolized, atomized, scattered, squirted, or otherwise discharged to coat base layer 43 and strands 41 and 42. Upon setting, curing, or drying, the material is joined, bonded, or otherwise secured to base layer 43 and strands 41 and 42. When deposited through printing, ink, toner, paint, or an at least partially liquid material may be printed upon base layer 43 and strands 41 and 42. Upon setting, curing, or drying, the material is joined, bonded, or otherwise secured to base layer 43 and strands 41 and 42. As a more specific example of printing, screen printing may be used to form a layer of ink on base layer 43 and strands 41 and 42. When applied through electroplating, a material may coat and join with base layer 43 and strands 41 and 42. When applied through filament accumulation, various polymer filaments accumulate upon base layer 43 and strands 41 and 42 to form a non-woven textile. Powdered thermoplastic polymer particles may also be applied, potentially through static charge or similar techniques. Stencils may also ensure that the material is applied to specific areas. Accordingly, various methods may be utilized to deposit a material that forms deposition layer 44 upon base layer 43 and strands 41 and 42.

Deposition layer 44 provides various advantages to footwear 10. As an example, the thickness of deposition layer 44 may be varied throughout tensile element 40. In some configurations, deposition layer 44 may have greater thickness in the areas of strands 41 and 42 and lesser thickness in areas where strands 41 and 42 are absent. As another example, spraying, printing, electroplating, filament accumulation, or similar processes have the potential to impart strong bonding between deposition layer 44 and each of base layer 43 and strands 41 and 42.

Based upon the above discussion, tensile element 40 generally includes two layers 43 and 44 with strands 41 and 42 located between. Although strands 41 and 42 may pass through one of layers 43 and 44, strands 41 and 42 generally lie adjacent to surfaces of layers 43 and 44 and substantially parallel to the surfaces layers 43 and 44 for more than twelve millimeters and even more than five centimeters. Spraying, printing, electroplating, filament accumulation, or similar processes may be utilized to deposit deposition layer 44 upon base layer 43 and strands 41 and 42.

Manufacturing Processes

Figure 8A:
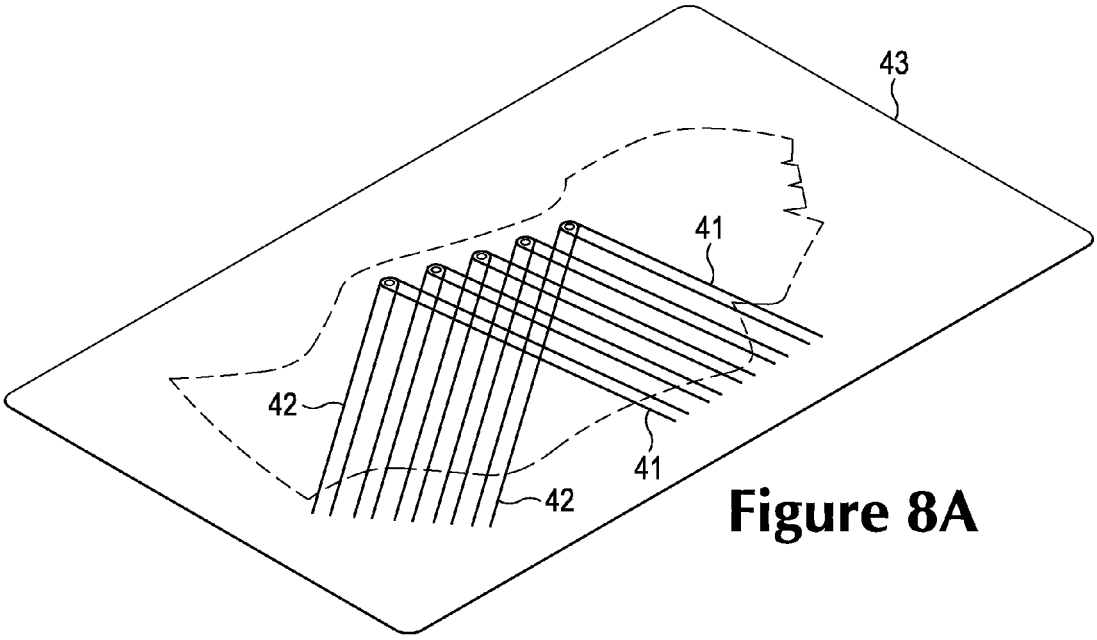
FIGS. 8A-8D are schematic perspective views depicting a method of manufacturing the tensile element.

A variety of processes may be utilized to manufacture tensile element 40. An example process that involves spraying to deposit deposition layer 44 will now be discussed. As an initial step in the process, strands 41 and 42 are positioned relative to base layer 43, as depicted in FIG. 8A. At this stage of the process, base layer 43 may be larger than the portion of base layer 43 that is formed within tensile element 40. For purposes of reference, a dashed line indicates the outline of the portion of base layer 43 that is formed within tensile element 40. An embroidery process may be utilized to locate strands 41 and 42 relative to base layer 43, as generally disclosed in U.S. patent application Ser. No. 11/441,924, which was filed in the U.S. Patent and Trademark Office on 25 May 2006 and entitled Article Of Footwear Having An Upper With Thread Structural Elements. Moreover, other stitching processes may be utilized to locate strands 41 and 42 relative to base layer 43, such as computer stitching. Additionally, processes that involve winding strands 41 and 42 around pegs on a frame around base layer 43 may be utilized to locate strands 41 and 42 over base layer 43. Accordingly, a variety of methods may be utilized to position strands 41 and 42 relative to base layer 43.

Figure 8B:
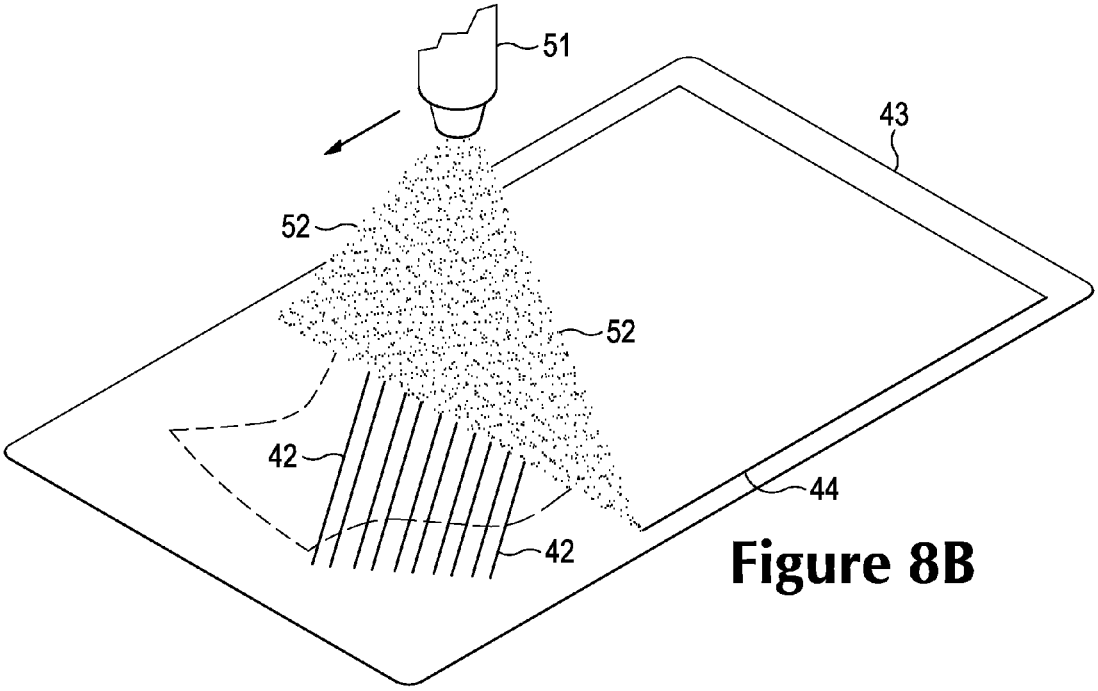
Figure 8C:
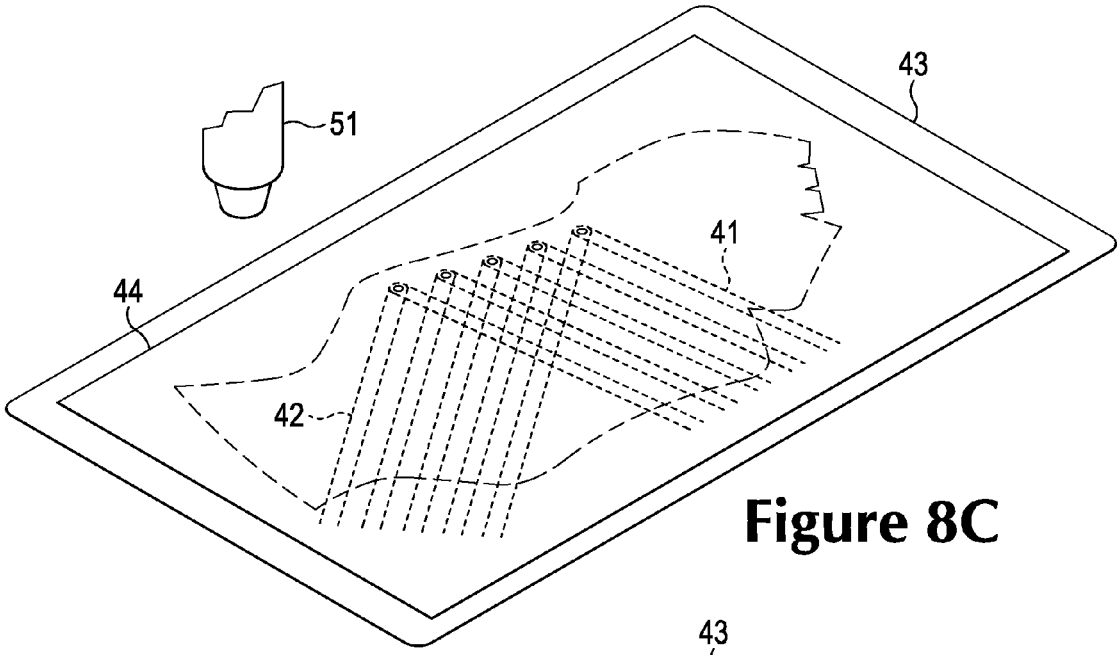
Figure 8D:
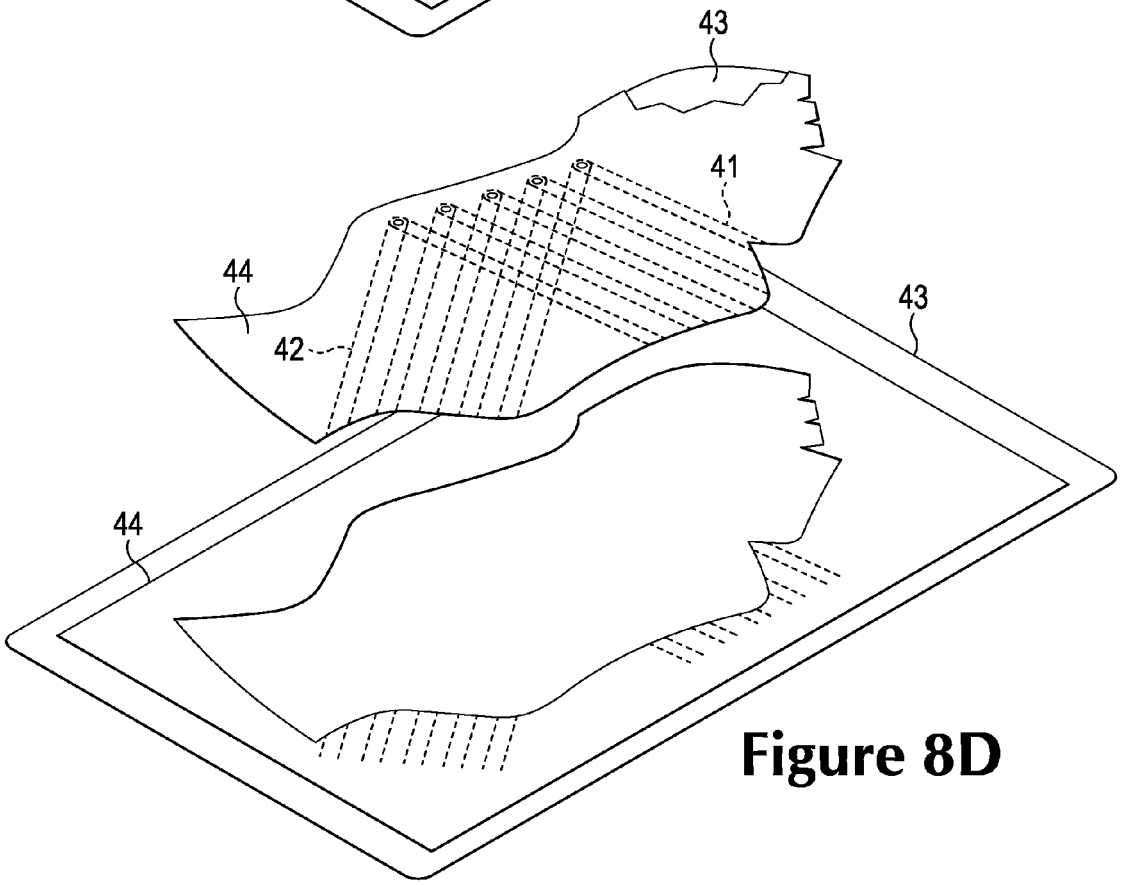

Continuing with the process, a nozzle 51 or other device is now positioned near base layer 43 and strands 41 and 42, as depicted in FIG. 8B. A material 52 that forms deposition layer 44 is then ejected from nozzle 51. More particularly, a polymer resin, a melted polymer, an adhesive, or an at least partially liquid material, for example, may be aerosolized, atomized, scattered, squirted, or otherwise discharged from nozzle 51 to coat base layer 43 and strands 41 and 42, thereby forming deposition layer 44. In some processes, multiple coats or sub-layers may be necessary to form deposition layer 44 to have a desired thickness. Upon setting, curing, or drying, the material 52 forming deposition layer 44 is joined, bonded, or otherwise secured to base layer 43 and strands 41 and 42, as depicted in FIG. 8C. Tensile element 40 may then be cut or otherwise removed from extraneous material, as depicted in FIG. 8D, and incorporated into upper 30 of footwear 10.

The general process discussed above may also be utilized to form deposition layer 44 through filament accumulation. More particularly, nozzle 51 also discharge polymer filaments that accumulate upon base layer 43 and strands 41 and 42. When discharged, the polymer filaments may be in a partially melted or softened state. Then, when accumulated upon base layer 43 and strands 41 and 42, the polymer filaments may bond with each other to effectively form a non-woven textile.

Figure 9A:
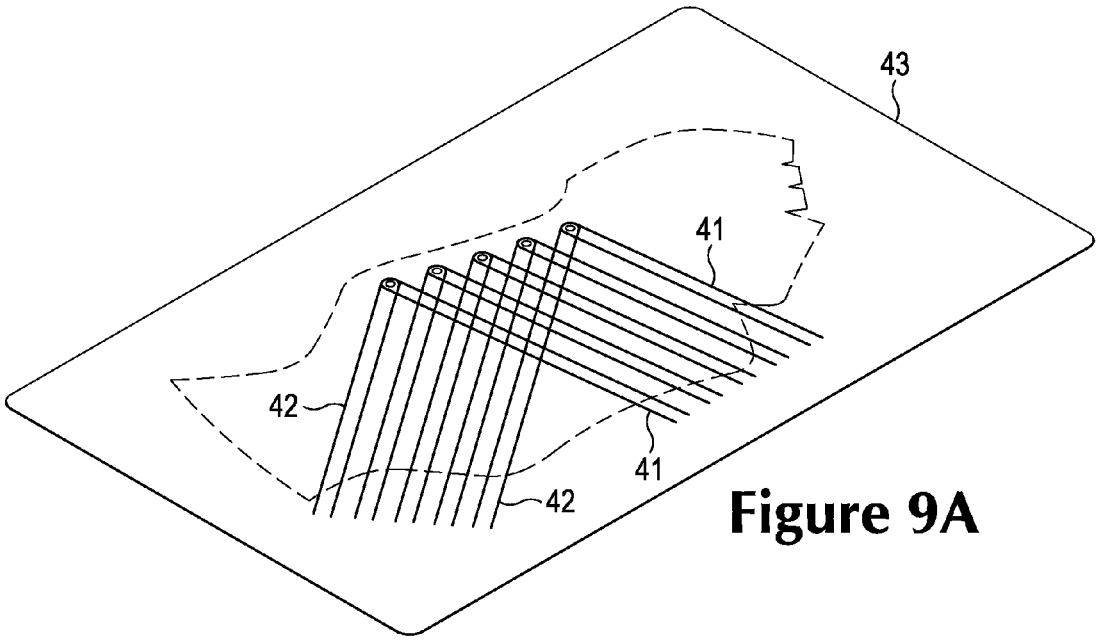
FIGS. 9A-9E are schematic perspective views depicting another method of manufacturing the tensile element.
Figure 9B:
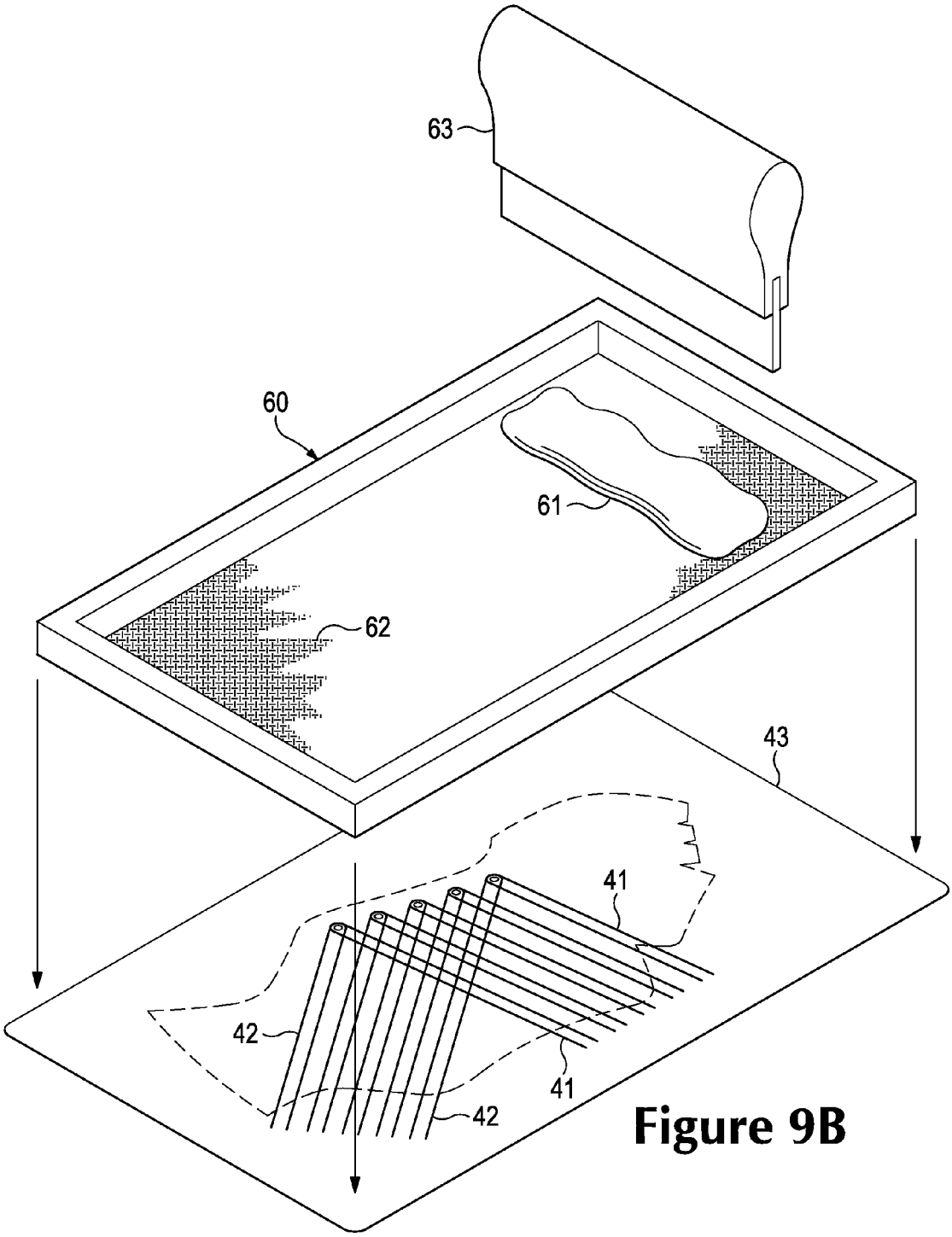
Figure 9C:
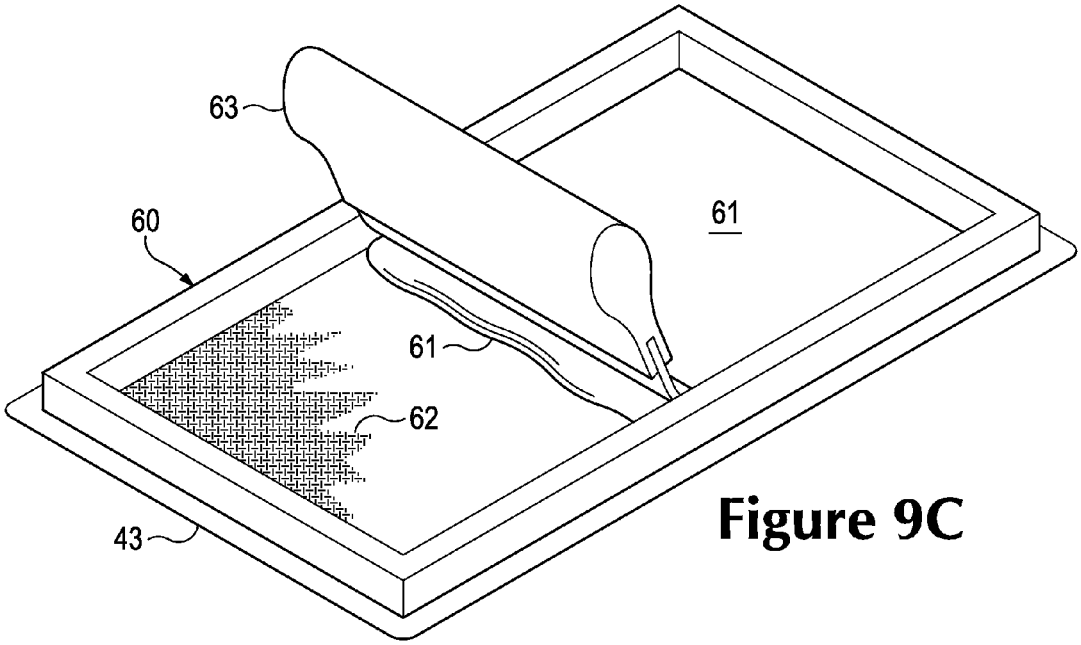
Figure 9D:
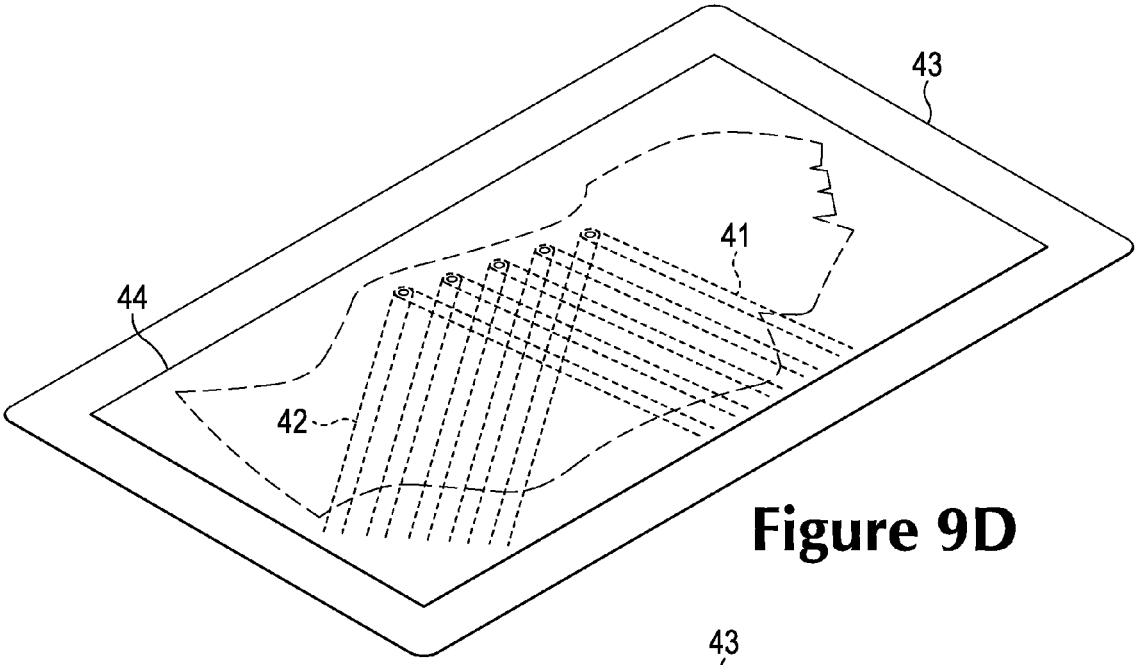
Figure 9E:
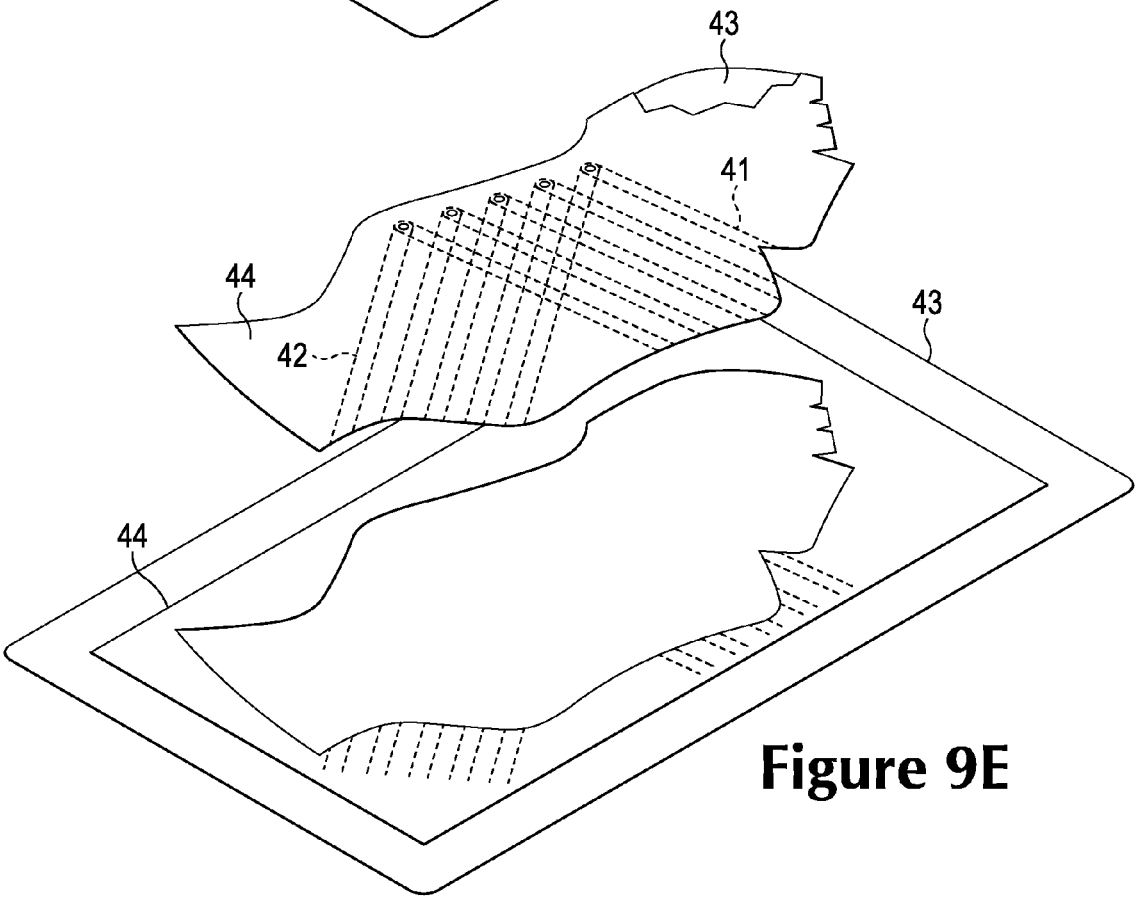

An example process that involves screen printing to deposit deposition layer 44 will now be discussed. As an initial step in the process, strands 41 and 42 are positioned relative to base layer 43, as depicted in FIG. 9A, using any of the methods discussed above. A screen printing apparatus 60 is now positioned above base layer 43 and strands 41 and 42, as depicted in FIG. 9B. A material 61 that forms deposition layer 44 is located within apparatus 60 and above a screen 62. Material 61 may be any ink that is suitable for screen printing operations, including a polymer material with a colorant, discharge ink, expanding ink, metallic ink, plastisol ink, and water-based ink, for example. Apparatus 60 is then positioned such that screen 62 contacts or is immediately adjacent to base layer 43 and strands 41 and 42, as depicted in FIG. 9C. A fill bar 63 is utilized to spread material 61 over screen 62 and through screen 62, thereby coating base layer 43 and strands 41 and 42 with material 61 and forming deposition layer 44. In some processes, multiple coats or sub-layers may be necessary to form deposition layer 44 to have a desired thickness. Upon setting, curing, or drying, the material 61 forming deposition layer 44 is joined, bonded, or otherwise secured to base layer 43 and strands 41 and 42, as depicted in FIG. 9D. Tensile element 40 may then be cut or otherwise removed from extraneous material, as depicted in FIG. 9E, and incorporated into upper 30 of footwear 10.

Both of the processes discussed above (i.e., spraying and screen printing) deposit material upon base layer 43 and strands 41 and 42 to form deposition layer 44. In these processes, relatively small drops of a material or a liquid form of the material is applied to base layer 43 and strands 41 and 42 to form deposition layer 44 directly upon base layer 43 and strands 41 and 42. In addition to spraying and screen printing, other methods of deposition may also be utilized, including additional printing processes, electroplating, and filament accumulation. In some configurations, thermoplastic polymer particles or powder may also be applied to base layer 43 to form deposition layer 44, and stencils or static charge may be utilized to locate the material in specific areas and ensure the material adheres to base layer 43. Accordingly, various methods may be utilized to deposit a material that forms deposition layer 44 upon base layer 43 and strands 41 and 42.

Further Footwear Configurations

Figure 10A:
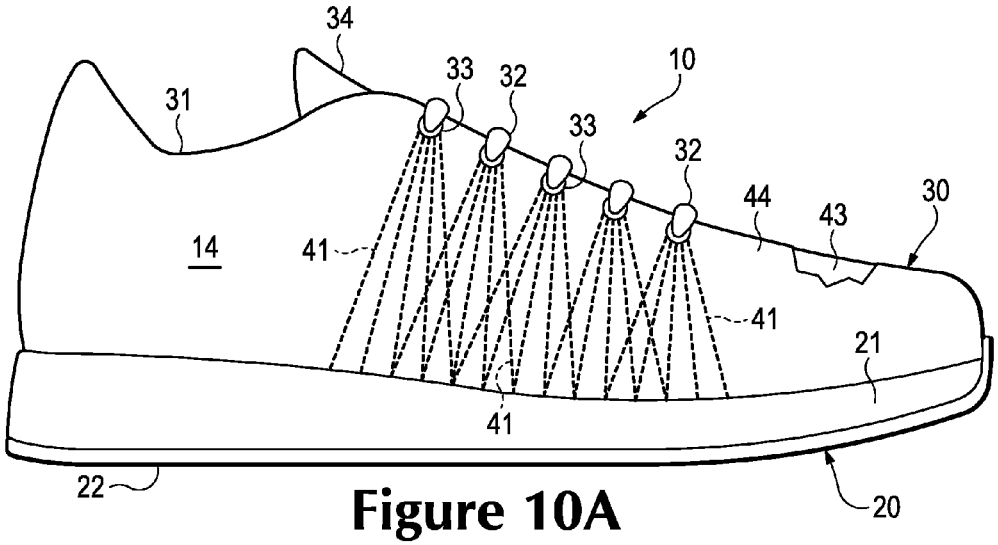
FIGS. 10A-10D are lateral side elevational views corresponding with FIG. 1 and depicting further configurations of the article of footwear.
Figure 10B:
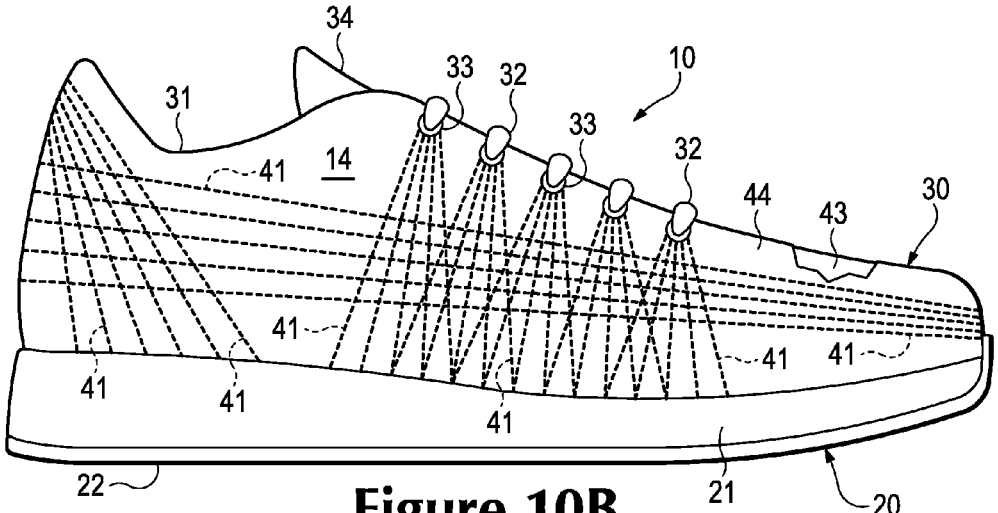
Figure 10C:
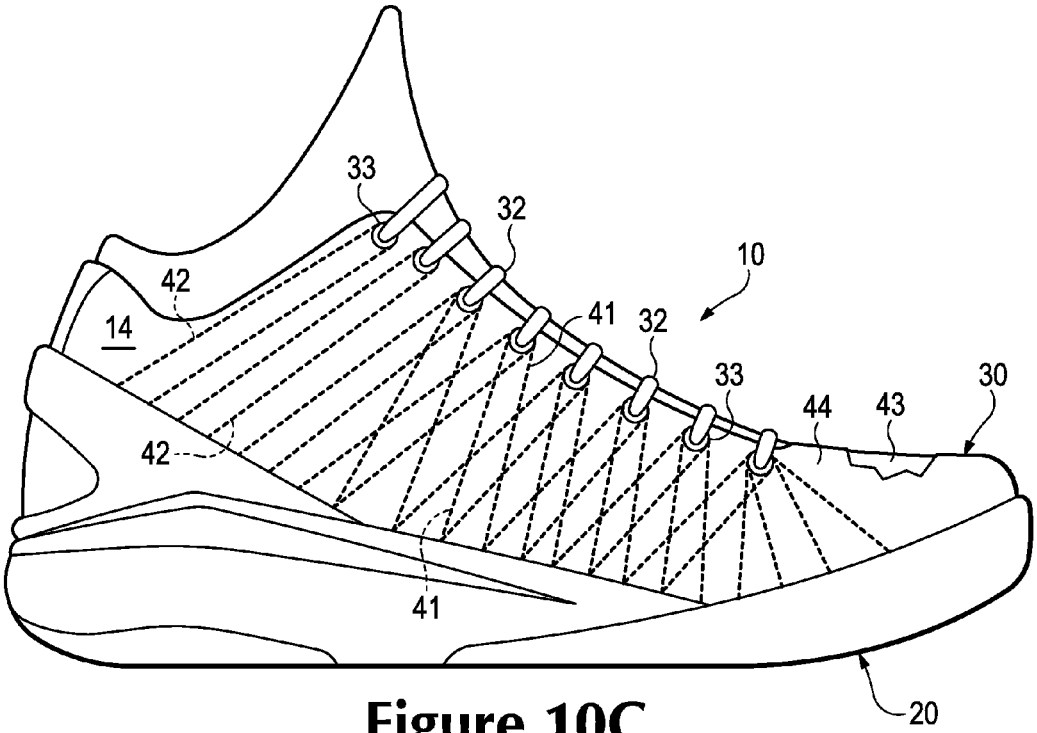

The orientations, locations, and quantity of strands 41 and 42 in FIGS. 1 and 2 are intended to provide an example of a suitable configuration for footwear 10. In other configurations of footwear 10, various segments of strands 41 and 42 may be absent, or additional strands 41 and 42 or segments of strands 41 and 42 may be present to provide further structural components in footwear 10. Referring to FIG. 10A, for example, four segments of strands 41 radiate outward from each lace aperture 33 and extend toward sole structure 20. In another configuration, depicted in FIG. 10B, additional segments of strands 41 extend through each of regions 11-13 to provide longitudinal support, and further strands 41 extend through heel region 13 to form a heel counter that resists heel movement. As noted above, the concepts disclosed herein apply to a wide variety of footwear types. Referring to FIG. 10C, footwear 10 footwear 10 has the configuration of a basketball shoe.

Figure 10D:
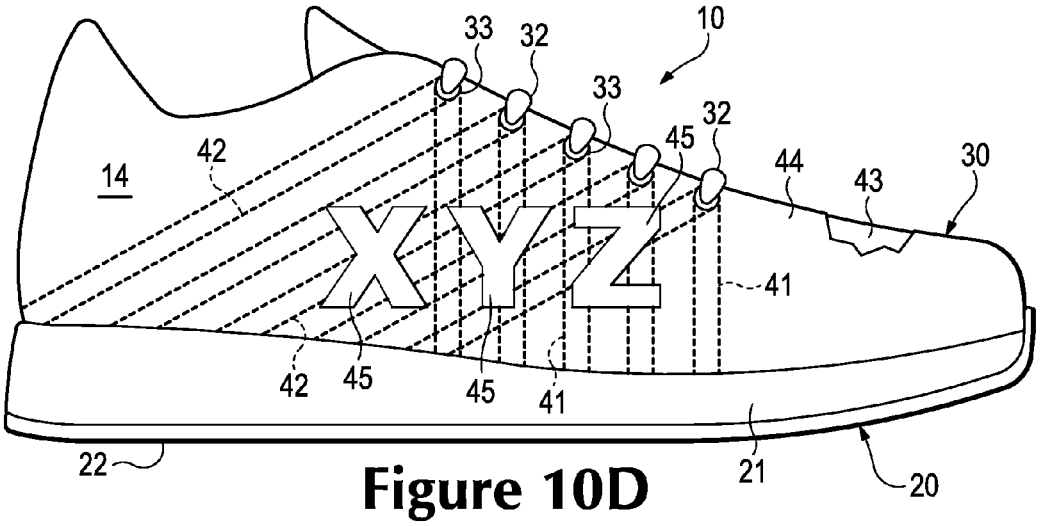

The screen printing process discussed above provides an opportunity to enhance the aesthetic or informational qualities of footwear 10. As an example, the screen printing process may be modified to print areas of deposition layer 44 with different colors. As another example, the screen printing process may be modified to print areas of deposition layer 44 that form indicia, such as trademarks, care instructions, directions, etc. As an example, FIG. 10D depicts a configuration wherein the screen printing process deposited an indicia layer 45 forming "XYZ" upon deposition layer 44. Whereas deposition layer 44 may be formed from a first ink with a first color, indicia layer 45 may be formed from a second ink with a second color. Accordingly, the screen printing process, other printing processes, and various deposition techniques may be utilized to enhance the aesthetics or provide indicia on footwear 10.

Figure 11A:
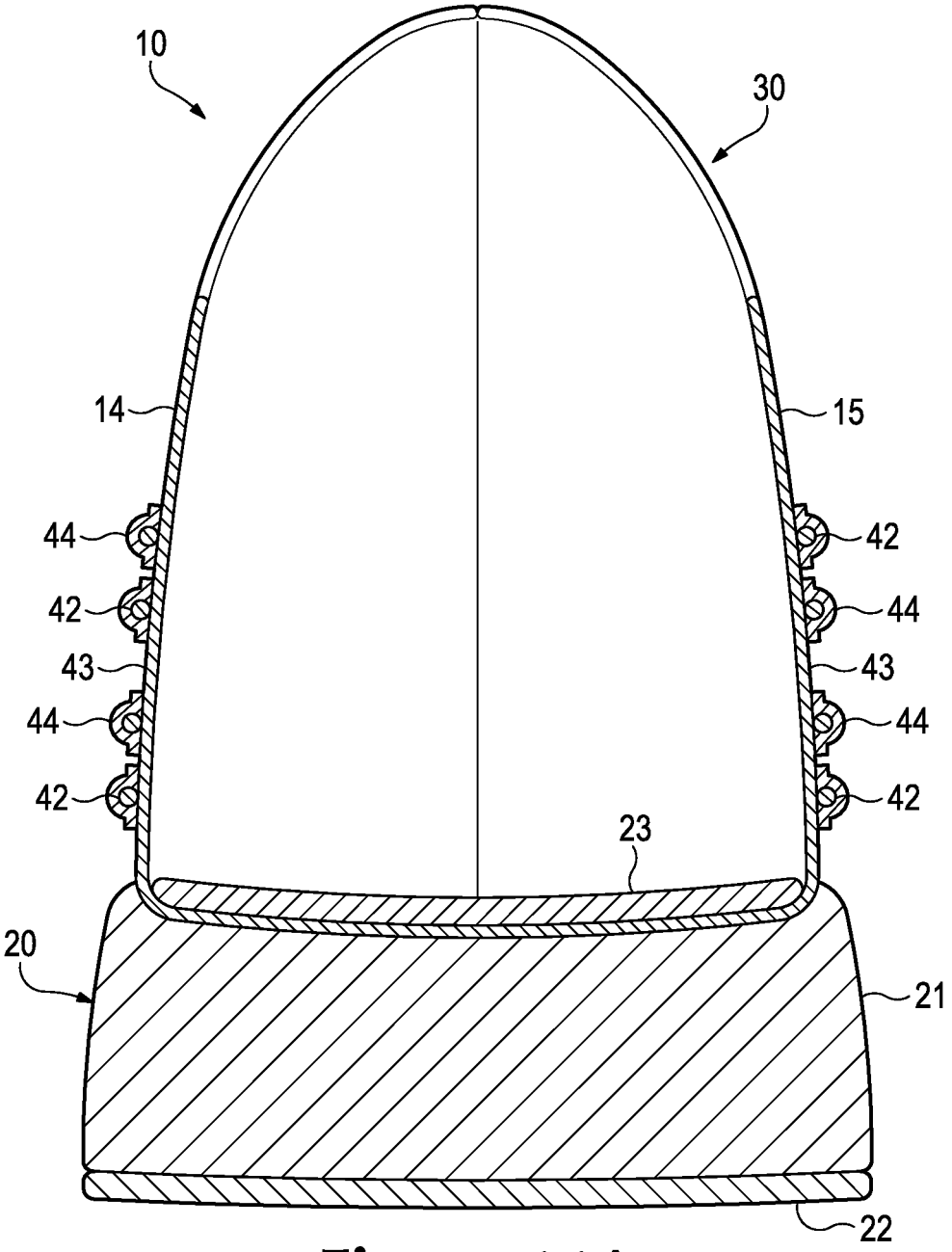
FIGS. 11A-11D are cross-sectional views corresponding with FIG. 3 and depicting further configurations of the article of footwear.
Figure 11B:
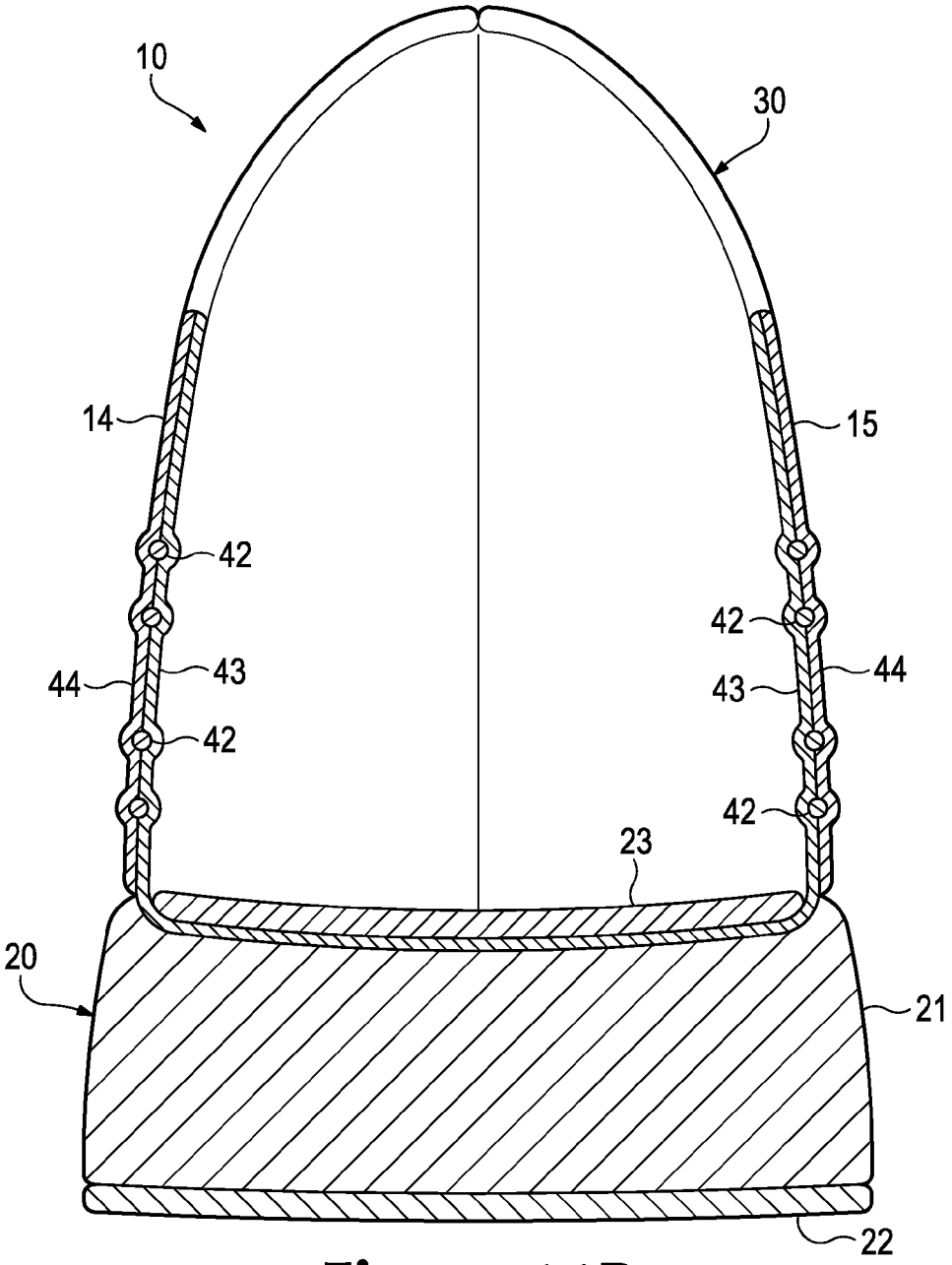
Figure 11C:
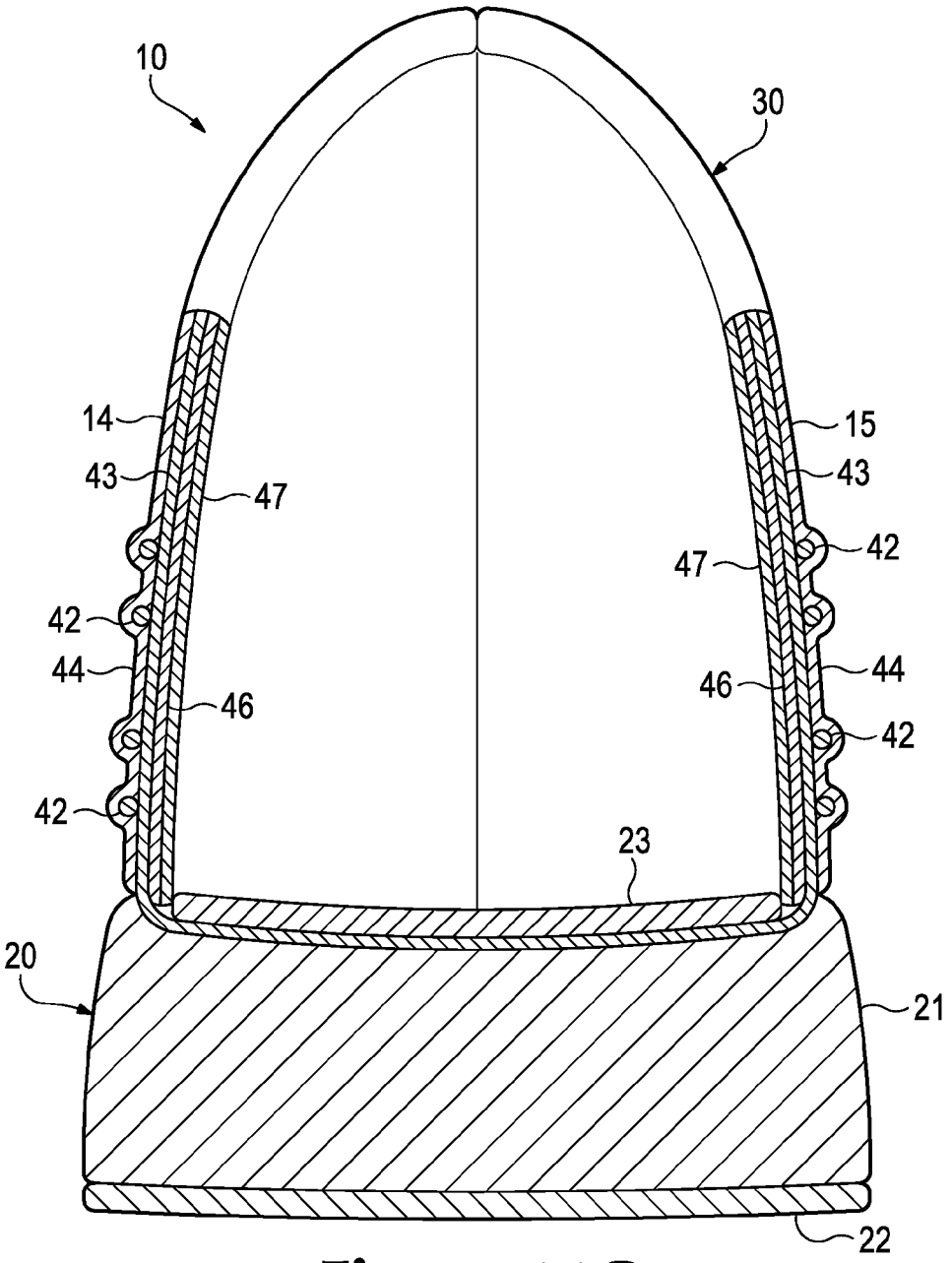
Figure 11D:
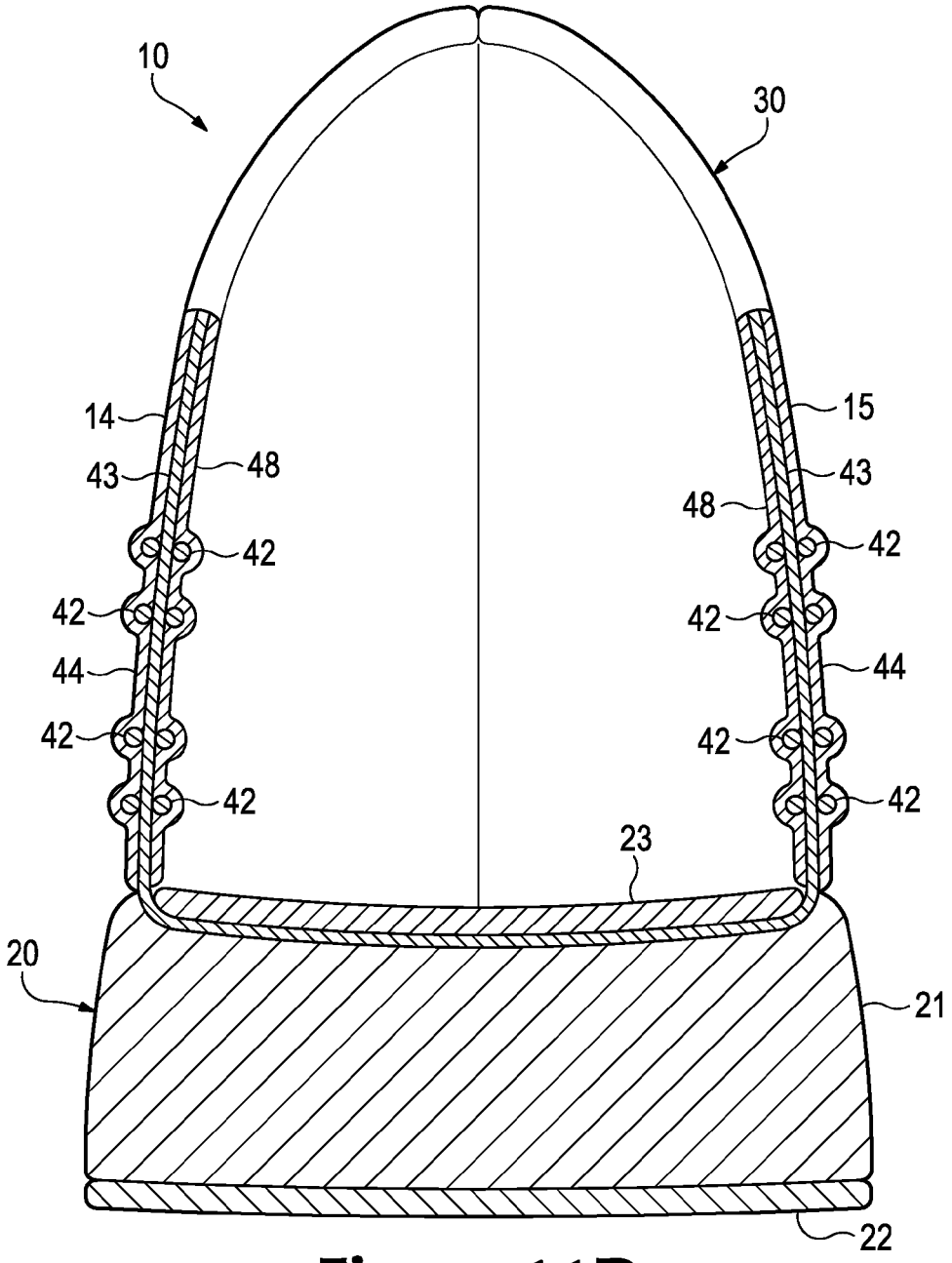

Various aspects relating to strands 41 and 42 and layers 43 and 44 in FIG. 3 are intended to provide an example of a suitable configuration for footwear 10. In other configurations of footwear 10, additional layers or the positions of strands 41 and 42 with respect to layers 43 and 44 may vary. Referring to FIG. 11A, deposition layer 44 covers selected areas of base layer 43. More particularly, deposition layer 44 is present in the areas of strands 42 (as well as strands 41), but is absent in areas between strands 42 and in other areas. In this configuration, deposition layer 44 is secured to a first area of base layer 43 and absent from a second area of the base layer 43. Moreover, deposition layer 44 forms a first portion of the exterior surface of upper 30, and base layer 43 forms a second portion of the exterior surface of upper 30. Referring to FIG. 11B, both of layers 43 and 44 protrude outward due to the presence of strands 42. In another configuration, depicted in FIG. 11C, additional layers 46 and 47 are located to form an interior portion of upper 30 that is adjacent to the void. Although layers 46 and 47 may be formed from various materials, layer 46 may be a polymer foam layer that enhances the overall comfort of footwear 10 and layer 47 may be a moisture-wicking textile that removes perspiration or other moisture from the area immediately adjacent to the foot. Referring to FIG. 11D, an additional set of strands 42 is located on an opposite side of base layer 43, with a backing layer 48 extending over the additional set of strands 42. This configuration may arise when an embroidery process is utilized to locate strands 41 and 42.

Conclusion

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. An article of footwear having an upper and a sole structure secured to the upper, at least a portion of the upper comprising:

a base layer having a first surface and an opposite second surface;

a plurality of strand segments located adjacent to the first surface and extending substantially parallel to the first surface for a distance of at least five centimeters; and a deposition layer that is deposited upon the first surface and the strand segments, the deposition layer being joined with the first surface and the strand segments;

wherein the deposition layer comprises a plurality of drops of a material that is built up directly upon the first surface and the strand segments; and, to better distinguish over the prior art of record.

2. The article of footwear recited in claim 1, wherein the deposition layer is a polymer material.

3. The article of footwear recited in claim 1, wherein the deposition layer is a screen printing ink.

4. The article of footwear recited in claim 1, wherein the deposition layer is a non-woven textile.

5. The article of footwear recited in claim 1, wherein the deposition layer forms at least a portion of an exterior surface of the upper.

6. The article of footwear recited in claim 1, wherein the deposition layer is secured to a first area of the base layer and absent from a second area of the base layer.

7. The article of footwear recited in claim 6, wherein the deposition layer forms a first portion of an exterior surface of the upper, and the second area of the base layer forms a second portion of the exterior surface of the upper.

8. The article of footwear recited in claim 6, wherein the strand segments are absent from the second area of the base layer.

9. The article of footwear recited in claim 1, wherein the deposition layer forms indicia.

10. The article of footwear recited in claim 1, wherein at least a portion of the strand segments extend from a lace area of the upper to an area where the sole structure joins the upper.

11. The article of footwear recited in claim 1, wherein the strand segments are selected from a group consisting of a filament, a yarn, a thread, and a cable.

12. A method of manufacturing an article of footwear, the method comprising:

laying a plurality of strand segments adjacent to a base layer, at least a portion of the strand segments extending substantially parallel to the base layer for a distance of at least five centimeters;

depositing an at least partially liquid material onto the base layer and the strand segments to form a deposition layer, the strand segments being located between the base layer and the deposition layer;

wherein the at least partially liquid material builds up directly upon the base layer and the strand segments to form the deposition layer such, to better distinguish over the prior art of record incorporating the base layer, strand segments, and deposition layer into an upper of the article of footwear.

13. The method recited in claim 12, wherein the step of depositing includes spraying the at least partially liquid material onto the base layer and the strand segments.

14. The method recited in claim 12, wherein the step of depositing includes screen printing the at least partially liquid material onto the base layer and the strand segments.

15. The method recited in claim 12, wherein the step of depositing includes screen printing multiple coats of the at least partially liquid material onto the base layer and the strand segments.

16. The method recited in claim 12, wherein the step of incorporating includes orienting the deposition layer to form at least a portion of an exterior surface of the upper.

* * * * *